United States Patent [19]

Waterbury

[11] Patent Number: 4,918,357

[45] Date of Patent: Apr. 17, 1990

[54] COMBINATION INCANDESCENT AND SOLAR-ELECTRIC LIGHT BULB WITH AUTOMATIC SWITCHING DEVICE AND CHARGING MEANS THEREFOR

[76] Inventor: Nelson J. Waterbury, 211 E. 70th Street, New York, N.Y. 10021

[21] Appl. No.: 73,563

[22] Filed: Jul. 15, 1987

[51] Int. Cl.[4] ..... H05B 39/10

[52] U.S. Cl. ..... 315/87; 315/86; 315/151; 362/183; 362/184

[58] Field of Search ..... 362/20, 157, 183, 184; 315/55, 86, 87, 151; 250/209, 215, 578

[56] References Cited

U.S. PATENT DOCUMENTS 2,067,653 1/1937 Witmer et al. ..... 315/86

3,324,304 6/1967 Duncan ..... 315/86

4,441,143 4/1984 Richardson ..... 362/183

*Primary Examiner*—David K. Moore

*Attorney, Agent, or Firm*—Cox & Smith Inc.

[57] ABSTRACT

A dual-filament light bulb with associated adapter apparatus which uses photovoltaic cells mounted within the light bulb to charge a battery which powers one of the filaments. The adapter apparatus is designed to mount in an ordinary light socket which provides external current to the other filament. The adapter apparatus includes circuitry which alternately switches from the filament powered by the battery to the filament powered by external current in a manner which reduces the amount of electricity needed to produce a given amount of light.

3 Claims, 3 Drawing Sheets

COMBINATION INCANDESCENT AND SOLAR-ELECTRIC LIGHT BULB WITH AUTOMATIC SWITCHING DEVICE AND CHARGING MEANS THEREFOR

BACKGROUND

The present invention relates to a conventional incandescent light bulb having at least two filaments enclosed in an evacuated glass bulb which is connected to an electric current to make them glow. The first filament is an incandescent type that is aligned parallel to a second filament that is equipped with a solar-photovoltaic array that collects the light energy that is being emitted and wasted from the first incandescent filament. One of the filaments is operated by ordinary 110V or 220 alternating current while the other is operated by current from a battery. The battery is charged by the photovoltaic array which converts a portion of the light emitted by the light bulb back into electrical energy, thereby increasing the light bulb's efficiency and lowering the operating cost.

On Jan. 27, 1880 Thomas Alva Edison was granted U.S. Pat. No. 223,898 on an electric lamp. Prior to Edison's invention, light by incandescence had been obtained from low resistance carbon rods placed in closed vessels in which the air had been replaced by other gases. Edison's invention consisted of carbon wire or sheets placed in a vacuum which protected against oxidation and injury to the filament. That, in Edison's day, was a radical departure from prior attempts at a commercially feasible electric lamp. The present invention represents yet a further improvement to the ubiquitous light bulb.

Dual-filament incandescent light bulbs are well-known in the prior art as a means of increasing the effective life of an incandescent bulb. These devices employ filament switching devices which upon failure of the primary filament, switches power to a secondary filament. Most of these devices use a fusible conductor which restrains a leaf-spring contact. When the primary filament fails, the surge of current which occurs due to the failing filament ruptures the fusible conductor. The rupture of the fusible conductor releases the leaf-spring contact which then causes power to be routed to the secondary filament rather than the primary filament.

Other devices have improved on the basic concept by designing switching devices which fit within a screw base the size of a conventional light bulb as disclosed by U.S. Pat. No. 4,580,079. None of these devices, however, by simply increasing the effective life of a single incandescent bulb, achieve any energy savings. That is, their sole utility is to be found in the convenience afforded to users of not having to change light bulbs as often as with single filament bulbs.

It is an object of the present invention, therefore, to provide a dual filament incandescent bulb which not only lasts longer than conventional single-filament bulb, but requires less power to operate over the life of the bulb. The present invention utilizes the fact that, in most applications, users of conventional incandescent bulbs find the bulbs to be too bright. Users of these bulbs therefore employ means such as lampshades which serve to block some of the light emitted by the light bulb in order to achieve the desired ambient lighting condition. Some consumers find, however, that even lampshades are inadequate to achieve the desired dimming of the emitted light. The light bulb industry has responded therefore, by producing light bulbs wherein the bulb is coated with a light absorbing substance enabling a dimmer or "softer" light to be emitted. These types of bulbs have been widely accepted by the public.

The means of blocking light emitted by incandescent bulbs described above, whether they be lampshades or coated bulbs, all result in a good portion of the light emitted by the bulb being wasted. This also means, of course, that the corresponding electrical energy which produced the light is wasted also. One reason that consumers have not simply resorted to lower wattage bulbs to achieve the desired reduction in emitted light is that a certain light level is desired which can reflect off of room surfaces. That is, when a lampshade is employed to block some of the light emitted by an incandescent bulb, the consumer still desires the light emitted through the top and bottom of the lampshade to be unattenuated. The unattenuated light may then reflect off of room surfaces to produce the desired ambient lighting condition. Similarly, in the case of coated light bulbs, the coating absorbs only certain frequencies of the light emitted by the filament, leaving others unattenuated. Consumers evidently desire only certain frequencies of the light emitted by the light bulb to attenuated. Since no incandescent filaments can be made which produce light having either the desired directional intensity variation or frequency characteristics desired by most consumers, light blocking devices are the only means available which enable incandescent bulbs to produce light having the characteristics desired by consumers for room lighting.

An object f the present invention is to provide an improved version of the original incandescent bulb invented by Thomas Alva Edison. It is an object of the present invention, therefore, to provide a means for lighting rooms in a manner acceptable to consumers with or without the concomitant use of an ordinary lampshade. It is a further object of the present invention to lessen the waste of electrical energy which occurs when the light emitted by an incandescent filament is partially blocked to achieve a desired lighting condition. A still further object of the present invention is to provide a means for extending the effective life of an incandescent filament.

SUMMARY OF THE INVENTION

The present invention comprises a novel dual-filament light bulb. The first filament is a conventional one designed to operate off of ordinary 110 V or 220 V alternating current while emitting the desired level of light. The second or so called solar filament is designed to emit the same level of light while operating off of direct current at a lower voltage supplied by a battery. Separate terminals are provided in the screw base of the bulb which enable each filament to be operated separately.

The present invention also comprises an adapter apparatus which screws into an ordinary light bulb socket. The dual filament light bulb described above screws into a specially designed socket of the adapter apparatus. The adapter apparatus contains a battery and electronic switching circuitry and either contains a battery or is connected to an external battery. The switching circuit alternately causes either 110 V or 220 V power from the ordinary light socket to operate the first filament, or direct current power from the battery to operate the second filament. Switching from one filament and power source to the other is automatically done according to the charge level of the battery.

Located within the dual-filament light bulb are a plurality of photovoltaic cells which absorb some of the emitted light and convert it to electrical energy. The photovoltaic cells also serve to block some of the emitted light while leaving the rest unattenuated in a manner so as to produce a lighting condition desired by a user of the present invention.

The electricity generated by the photovoltaic cells is used to charge the battery either located in the adapter apparatus or connected externally. The same circuitry used to control the operation of the two filaments is also used to regulate the charging of the battery.

DETAILED DESCRIPTION OF THE INVENTION

Figure 1:
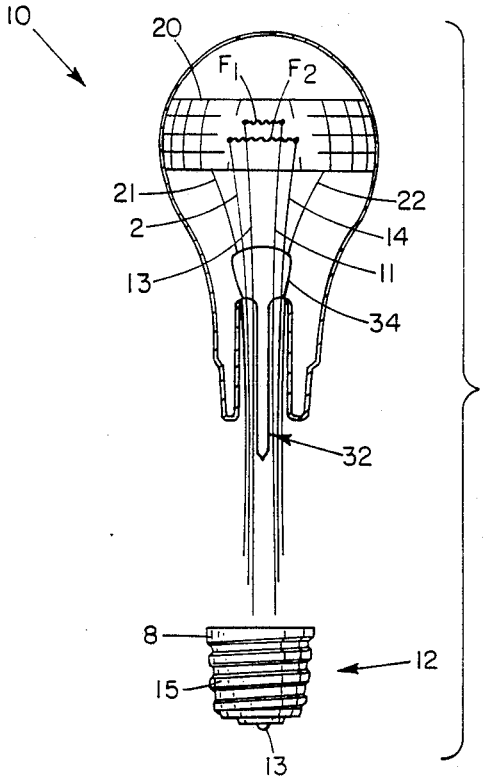
FIG. 1 depicts the dual-filament bulb, showing an exemplary placement of the photovoltaic cells, and the light bulb base.

Referring to FIG. 1, there is shown dual-filament light bulb 10. Light bulb 10 houses a pair of incandescent filaments F1 and F2 which are mounted on lead wire pair 11 and 13 and lead wire pair 2 and 14, respectively. The wire pairs are embedded within evacuation tube 32 at its upper press 34. Also shown surrounding filaments F1 and F2 within bulb 10 are a plurality of photovoltaic cells 20. Photovoltaic cells 20 are mounted on lead wire pair 21 and 22. Lead wire pair 21 and 22 is also embedded within evacuation tube 32 at its upper press 34. Photovoltaic cells 20 are preferably of the amorphous silicon type designed to operate at the temperature existing within bulb 10 when either of filaments F1 or F2 are conducting current.

Figure 2:
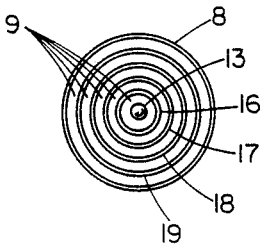
FIG. 2 is an end-on view of the light bulb base of the dual-filament bulb showing the different terminals used to operate the filaments and charge the battery.

Shown in FIG. 1 is light bulb base 12 of bulb 10 consisting of a metal shell 8 into which are formed threads 15. Although the drawings and the following description refer to the screw type of light bulb base common in standard light bulbs in the United States, any type of light bulb base may be used. FIG. 2 is an end-on view of light bulb base 12 showing eyelet 13 and ring contracts 16, 17, 18, and 19. The ring contacts, eyelet 13, and metal shell 8 are electrically isolated from one another by insulating material 9. Bulb 10 is mounted on light bulb base 12 while the lead wires are electrically connected to individual contacts. In this preferred embodiment, lead wires 21 and 22 are connected to ring contacts 18 and 19 while lead wires 11 and 13 are connected to ring contacts 16 and 17. Lead wires 2 and 14 are connected to eyelet 13 and metal shell 8, respectively.

Filament F2 is designed to operate at an appropriate wattage when ordinary 110 V alternating current is impressed across eyelet 13 and metal shell 8. Filament F1 is designed to operate at a similar wattage, and therefore emit the same amount of light as filament F2, when a lower D.C. voltage is impressed across ring contacts 16 and 17.

Figure 3:
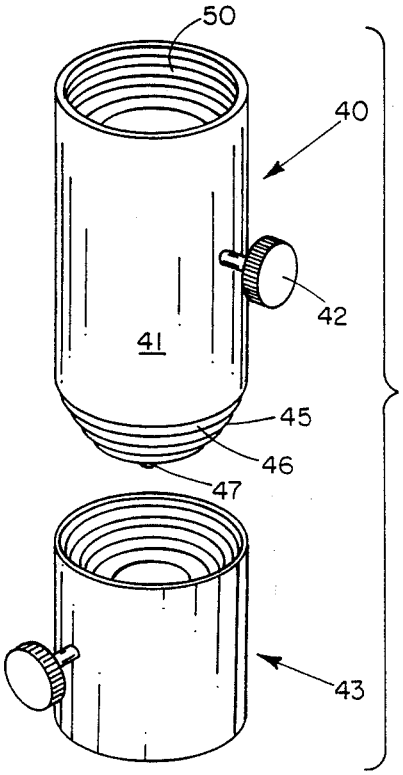
FIG. 3 is a depiction of the adapter apparatus.

Shown in FIG. 3 is adapter apparatus 40. Adapter apparatus 40 consists of a housing 41, a light bulb type base 45, a light bulb base receptacle 50, and a manual switch 42. Light bulb type base 45 is designed as a conventional light bulb base which mounts into an ordinary light bulb socket 43. Light bulb type base 45 then receives 110V (or other conventional voltage level) across metal shell 46 and eyelet 47 when the socket is turned on.

Light bulb base receptacle 50 is designed to threadably engage light bulb base 12 of dual-filament light bulb 10. Metal shell of receptacle 50 has threads and an eyelet (not shown) which correspond to and make electrical contact with threads 15 and eyelet 13 of light bulb base 12, respectively. Within light bulb base receptacle 50 are electrical contacts which correspond to the electrical contacts of light bulb base 12. Corresponding ring contacts of receptacle 50 make electrical contact with ring contacts 16, 17, 18, and 19 of light bulb base 12 when light bulb base 12 is fully seated in receptacle 50.

Figure 4:
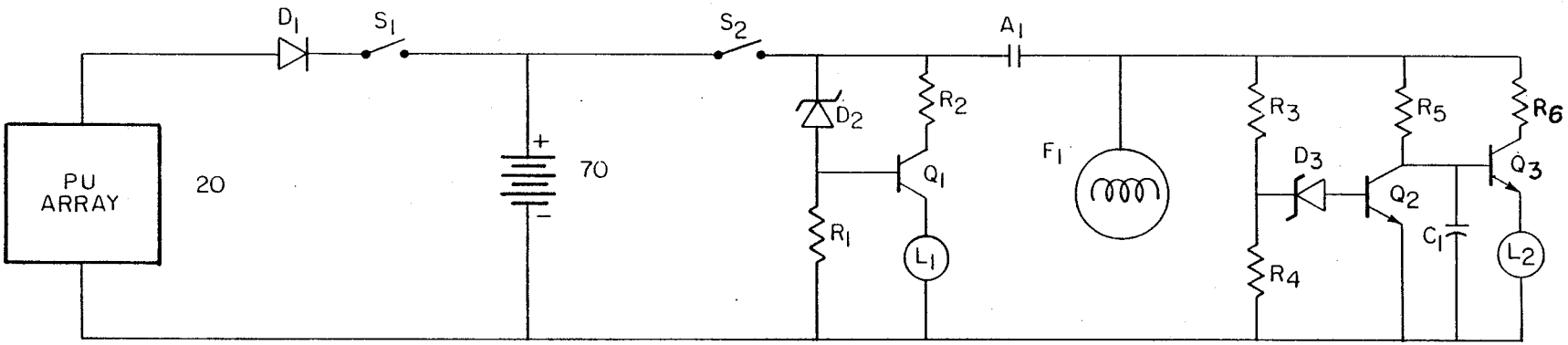
FIG. 4 is an electrical schematic of the control circuitry and shows how the battery is connected to one of the filaments of the light bulb.

Within housing 41 is located switching circuit 60 as well as a battery 70 (see FIG. 4). Battery 70 may be of any appropriate type such as the nickel-cadmium variety. In an alternate embodiment, batter 70 is located external to adapter apparatus 40. Switching circuitry 60, which is described in detail below, serves to regulate the charging of battery 70 by photovoltaic cells 20 through ring contacts 18, 19, and the corresponding ring contracts of receptacle 50. Depending on the charge level of battery 70, switching circuitry 60 also either routes power from battery 70 to filament F1 through ring contacts 16, 17, and the corresponding ring contracts of receptacle 50 or routes power from socket 43 to filament F2 by way of eyelets and metal shells 8 light bulb base receptacle 50, respectively.

The operation of the apparatus that is the present invention is as follows. Dual-filament light bulb 10 is mounted in light bulb base receptacle 50 of adapter apparatus 40. Screw base 45 of adapter apparatus 40 is mounted into an ordinary light bulb socket 43 designed to transmit ordinary 110 V (or other conventional voltage level) alternating current. Socket 43 can be left on as no current is transmitted to bulb 10 until switch 42 is turned to the on position. Assuming that battery 70 is uncharged, when switch 42 is turned to the on position, power is transmitted by switching circuit 60 from socket 43 to filament F2. Light bulb 10 then operates as an ordinary incandescent bulb. As filament F2 continues to emit light, however, photovoltaic cells 20 convert some of the light energy to electrical energy which is transmitted to battery 70 via ring contacts 18, 19, and the corresponding ring contacts of receptacle 50. When battery 70 is charged to a specified voltage level, switching circuit 60 electrically disconnects filament F2 from socket 43 and electrically connects battery 70 to filament F1. The light energy emitted by filament F1 is completely derived from the light energy previously emitted by filament F2. That is, the apparatus is drawing no current from the socket 43 as filament F1 burns.

As filament F1 burns, battery 70 discharges. The discharging of battery 70 is slowed somewhat, however, by the fact that photovoltaic cells 20 continue to operate. When battery 70 has discharged to a specified voltage level, switching circuit 60 electrically disconnects filament F1 from battery 70 and electrically connects filament F2 to socket 43. The apparatus then operates as before until battery 70 is recharged to the specified voltage level at which point the cycle repeats.

Figure 5:
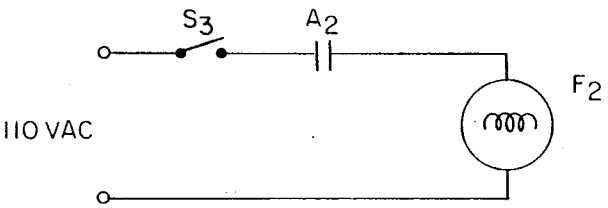
FIG. 5 is an electrical schematic showing how exemplary 110 V power is connected to one of the filaments of the light bulb.
Figure 6:
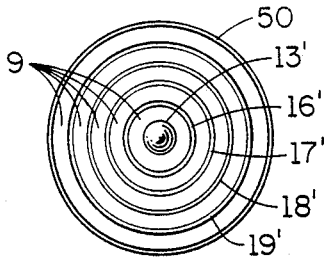
FIG. 6 is a cross-sectional end-on view of adapter apparatus 40 showing the ring contacts at the bottom of receptacle 50.

Referring now to FIGS. 4 and 5, there is shown an electrical schematic of switching circuit 60. Previously described manual switch 42 is a multi-pole switch which serves to simultaneously operate switches S1, S2, and S3 shown in FIGS. 4 and 5. Switching circuit 60 is not operative until switches S1, S2 and S3 are closed by manually turning switch 42 to the on position.

Relay contacts A1 and A2 are operated by relay coils L1 and L2. The relay unit is configured such that when coil L1 is energized, contact A2 is opened while contact A1 is closed. When coil L2 is energized, on the other hand, contact A2 is closed while contact A1 is opened. The circuit is designed so that at no time can coils L1 and L2 be energized simultaneously. No change in the states of contacts A1 or A2 occurs when either of coils L1 and L2 become de-energized.

Assume that battery 70 is initially uncharged, contact A2 is closed, and contact A1 is open. As switches S1, S2 and S3 are closed, 110 V power from socket 43 is transmitted to filament F2 as shown in FIG. 5. As shown in FIG. 4, battery 70 is not connected to filament F1 owing to the open state of contact A1. As filament F2 burns, however, photovoltaic array 20 converts some of the emitted light energy to electrical energy. Photovoltaic array 20 then charges battery 70 through blocking diode D1. Blocking diode D1 allows current to flow from photovoltaic array 20 to battery 70 but blocks current in the other direction. This prevents battery 70 from discharging through photovoltaic array 20 when photovoltaic array 20 is generating no voltage. Thus, filament F2 burns as an ordinary incandescent filament while charging battery 70.

Until battery 70 is charged to a specified voltage level, Zener diode D2 effectively draws no current. This maintains transistor Q2 in an off condition and prevents coil L1 from being energized. It should also be appreciated that switching circuit 60 is drawing no current from battery 70 while battery 70 is being charged except for the small leakage current flowing through Zener diode D2. When the voltage level of battery 70 rises to a specified value, however, Zener diode D2 reaches an avalanche condition which results in current flowing into the base of transistor Q1. This turns on transistor Q1 which causes the emitter current to flow through coil L1. As coil L1 is energized, contact A2 is opened while contact A1 is closed. This results in filament F1 being electrically connected to battery 70 while filament F2 is turned off. As battery 70 discharges through filament F1, the voltage level drops below that needed to maintain transistor Q1 in a saturated state thus de-energizing coil L1. However, contact A1 remains closed and contact A2 remains open. Thus, the energy stored by battery 70 is emitted as light through incandescent filament F1.

Closed contact A1 also transmits current from battery 70 through resister R3 and Zener diode D3 to the base of transistor Q2. Resistors R3 and R4 and Zener diode D3 are specified such that until the voltage level of battery 70 drops to a specified level, Zener diode D3 is in an avalanche condition which maintains transistor Q2 in a saturated state. The collector of transistor Q2 is connected to the base of transistor Q3. Thus when transistor Q2 is turned on, the voltage of battery 70 is dropped across resistor R5. The collector of transistor Q2 is thus held low, and transistor Q3 is maintained in an off condition. When the voltage of battery 70 drops to a specified level, however, Zener diode D3 no longer conducts current into the base of transistor Q2. As transistor Q2 is turned off its collector is pulled up to the voltage level of battery 70. This results in transistor Q3 being turned on, and current flows from the emitter to coil L2. As coil L2 becomes energized, contact A1 is opened while contact A2 is closed. The cycle then repeats in the manner described above.

Capacitor C1 serves to prevent transistor Q3 from turning on when contact A1 is initially closed by the energization of coil L1. When contact A1 is initially closed, capacitor C1 draws current flowing through resistor R5 until transistor Q2 becomes saturated. Without capacitor C1, there is the possibility that transistor Q3 could turn on momentarily before transistor Q2 turns on. The resulting energization of coil L2 would then reverse the state of contacts A1 and A2, thus preventing filament F1 from operating.

In summary, switching circuit 60 is designed to alternately operate either filament F1 or F2 according to the voltage level of battery 70. Hysteresis is inherently built into the switching circuit which allows the battery to charge to a certain voltage level and discharge to lower voltage level. Switching circuit 60 also regulates the charging of battery 70 so that no other circuitry is needed to prevent overcharging battery 70. Switching circuit 60 is isolated from any external power source, being powered completely by energy stored in battery 70. Switching circuit 60 draws no current while battery 70 is being charged, thus increasing the efficiency of the apparatus. Furthermore, coils L1 and L2 operate only momentarily when effecting changes in the states of contacts A1 and A2.

Although the invention has been described in conjunction with the foregoing specific embodiment, many alternatives, variations and modifications are apparent to those of ordinary skill in the art. Those alternatives, variations and modifications are intended to fall within the spirit and scope of the appended claims.

What is claimed is:

1. A dual-filament incandescent light bulb comprising:

a transparent or translucent evacuated bulb mounted on a light bulb base; first and second filaments and an array of photovoltaic cells mounted within said bulb wherein said first and second filaments and said array of photovoltaic cells are connected to separate electrical contacts within said base.

2. A dual-filament incandescent light bulb as set forth in claim 1 further comprising:

a battery;

means for charging said battery electrically connected between said battery and said photovoltaic array for charging said battery;

means for electrically connecting said first filament to a source of electrical energy;

means for electrically connecting said battery to said second filament and disconnecting said source of electrical energy from said first filament when said battery has charged to a specified voltage level; and means for electrically disconnecting said battery from said second filament and electrically connecting said source of electrical energy to said first filament when said battery has discharged to a specified voltage level.

3. A dual-filament incandescent light bulb as set forth in claim 2, further comprising:

a housing;

a light bulb type base formed at one end of said housing and adapted to be mounted into and receive power from a conventional light bulb socket;

a light bulb base receptacle formed at the other end of said housing and adapted to receive said light bulb base of said dual-filament light bulb and containing separate electrical contacts corresponding to the separate electrical contacts of said light bulb base wherein said housing is adapted to house said battery, said means for charging said battery, said means for electrically connecting said battery to said second filament, and said means for electrically disconnecting said battery from said second filament.

* * * * *